United States Patent [19]

Wallis

[11] Patent Number: 4,741,192

[45] Date of Patent: May 3, 1988

[54] ROLLING METAL RIBBON STOCK INTO CONVOLUTED FIN STRIP FOR USE IN HEAT EXCHANGERS

[76] Inventor: Bernard J. Wallis, 2215 Dacosta Ave., Dearborn, Mich. 48128

[21] Appl. No.: 885,033

[22] Filed: Jul. 14, 1986

[51] Int. Cl.[4] ..... B21D 53/02; B21C 47/24

[52] U.S. Cl. ..... 72/187; 72/17; 74/337.5; 74/378; 74/417; 74/665 GB; 242/58; 242/75.51; 242/78.6

[58] Field of Search ..... 242/58, 75.51, 78.6; 74/337.5, 417, 378, 665 GB; 72/187, 17

[56] References Cited

U.S. PATENT DOCUMENTS

| | | | |
|---|---|---|---|
| 2,405,637 | 8/1946 | Behrens | 242/58 |
| 2,825,016 | 2/1958 | Bailey | 242/75.51 |
| 3,478,974 | 11/1969 | Roscoe et al. | 242/58 |
| 4,216,804 | 8/1980 | Alexander, III et al. | 242/75.51 |
| 4,507,948 | 4/1985 | Wallis | 72/187 |
| 4,597,316 | 7/1986 | Ichikawa | 242/58 |

FOREIGN PATENT DOCUMENTS

| | | | |
|---|---|---|---|
| 19028 | 1/1984 | Japan | 242/78.6 |
| 61469 | 4/1985 | Japan | 242/78.6 |

*Primary Examiner*—Lowell A. Larson

*Attorney, Agent, or Firm*—Barnes, Kisselle, Raisch, Choate, Whittemore & Hulbert

[57] ABSTRACT

In an apparatus for rolling metal ribbon stock into convoluted fin strip for use in heat exchangers, an uncoiler apparatus comprising a base, a pair of coil supports for supporting a pair of coils of sheet metal ribbon stock. The coil supports are mounted on a plate which is rotatable about a vertical axis so that when the plate is rotated, one coil support is moved into driving engagement with the motor and the other coil support is moved out of driving engagement with the motor. A control system interconnects the drive of the motor on the uncoiler apparatus with the drive of the remainder of the corrugated fin rolling machine for positively driving the uncoiler as a function of machine speed.

4 Claims, 6 Drawing Sheets

ROLLING METAL RIBBON STOCK INTO CONVOLUTED FIN STRIP FOR USE IN HEAT EXCHANGERS

This invention relates to the manufacture of heat exchanger strips; that is, a metal strip having transversely extending corrugations along the length thereof.

BACKGROUND AND SUMMARY OF THE INVENTION

In the manufacture of metal strips having transversely extending corrugations along the length thereof, it is common to feed the stock from a coil between forming rolls to form the corrugations. Typical apparatus for use in such manufacture is shown, for example, in U.S. Pat. Nos. 3,998,600, 4,067,219, 4,262,568 and 4,507,948. Ribbon stock is typically withdrawn from the coil by pinch rollers or the like. Coil inertia and drag during start-up deleteriously affect control of fin height. Moreover, such inertia and drag vary as coil diameter decreases. In the event of machine shut-down, coil momentum continues to unwind ribbon stock. When the supply of ribbon stock from a coil is exhausted, it becomes necessary to stop the machine, remove the spool of exhausted coil, replace it with a fresh coil and restart the machine.

Among the objectives of the present invention are to provide an uncoiler apparatus to be utilized with a corrugated fin rolling machine which will facilitate the rapid change of coils; wherein the coil is positively driven in timed relation to the machine to reduce problems associated with varying drag and inertia at the coil; wherein the control of the drive is varied as the radius of the stock on the coil is reduced; and wherein the speed of drive is controlled to provide a proper and continuous speed of formation of the corrugated metal strip.

In accordance with the invention, in an apparatus for rolling metal ribbon stock into convoluted fin strip for use in heat exchangers, an uncoiler apparatus comprises a base and a pair of coil supports for supporting a pair of coils of sheet metal ribbon stock. The coil supports are mounted on a plate which is rotatable about a vertical axis so that when the plate is rotated, one coil support is moved into driving engagement with a coil device motor and the other coil support is moved out of driving engagement with the motor. A control system interconnects the drive of the motor on the uncoiler apparatus with the drive of the remainder of the corrugated fin rolling machine.

DESCRIPTION

Figure 1:
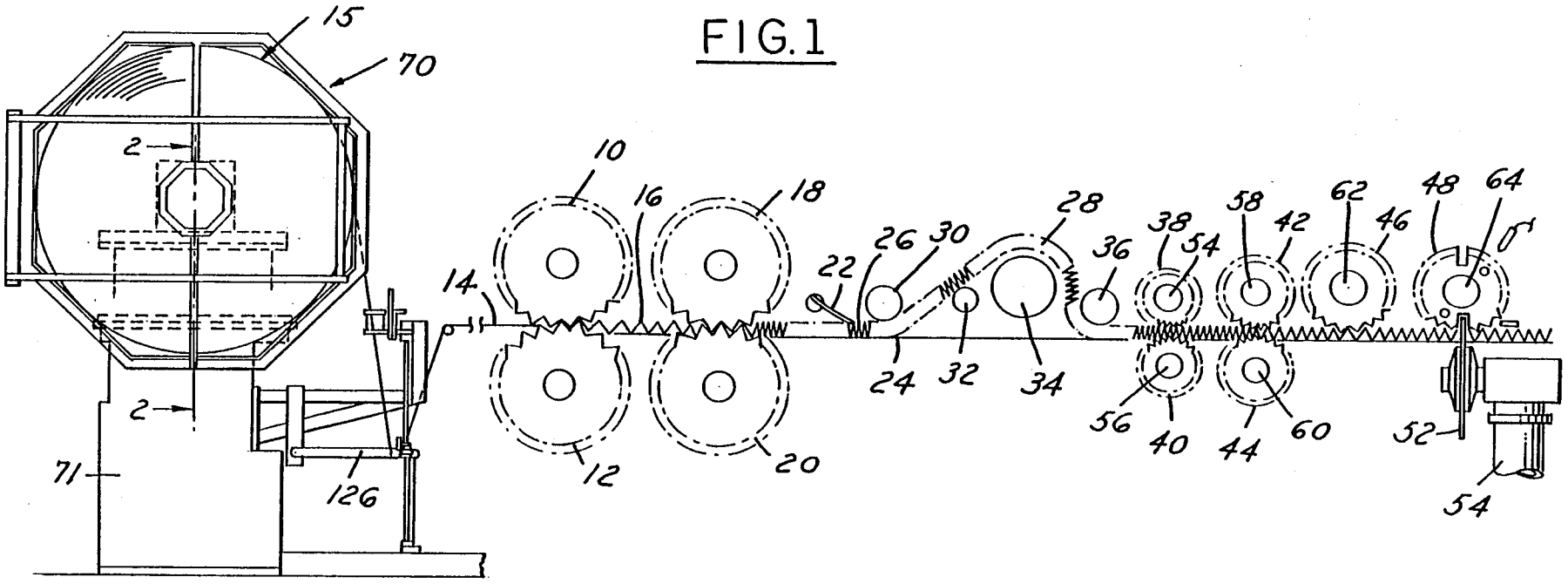
FIG. 1 is a diagrammatic elevational view of an apparatus for forming corrugated strip and cutting it to length in accordance with the present invention.

Referring first to FIG. 1, there is illustrated a corrugated fin rolling machine, several features of which are conventional. The machine includes a pair of form rolls 10, 12 mounted on the frame of the machine and in intermeshing relation as illustrated. Sheet metal ribbon stock 14 is fed from a coil 15 between form rolls 10, 12 so as to form corrugations therein. The corrugated strip is designated 16 and is directed from rolls 10, 12 downstream to a pair of gathering rolls 18, 20 which advances the corrugated strip toward a spring pressure plate 22. Pressure plate 22 cooperates with a bottom supporting rail 24 on which the corrugated strip is advanced to frictionally retard the forward movement of the corrugated strip so that it is compacted or compressed lengthwise by further bending at the crests of the convolutions. It will be observed in FIG. 1 that the crests 26 of the corrugated strip are spaced much closer together in the section of the strip between rolls 18, 20 and spring plate 22 than are the corrugations of the section of the strip between rolls 10, 12 and 18, 20. When the strip 14 is formed from some types of aluminum alloys, the metal has little resiliency and negligible spring-back characteristics. Thus, the spacing between the successive convolutions 26 in any section along the length of the corrugated strip tends to remain the same unless this spacing is changed by either stretching or compacting the strip lengthwise.

After the strip is fed past spring plate 22, it is advanced around idle rolls 30, 32, 34, 36 to form a take-up loop 28. The provision of this loop 28 is desirable since, as explained hereinafter, the upstream rollers 10, 12 and 18, 20 are rotated continuously while the rolls downstream from roll 36 are operated intermittently. Thus, the loop 28 increases in size when rotation of the downstream rolls is reduced, and then becomes progressively smaller when rotation of the downstream rolls is resumed. Since loop 28 freely expands and contracts in size, it follows that the corrugated strip is neither stretched nor compressed as it advances through the loop. Thus, the crest spacing in this section of the strip remains relatively constant and is substantially the same as produced by the action of spring plate 22. Downstream from roll 36, there is arranged a pair of toothed feed rollers 38, 40 spaced vertically from each other so that the teeth on upper roll 38 engage between the successive upper crests of the corrugated strip and the teeth on lower roll 40 engage between the successive lower crests on the corrugated strip. The pitch of the teeth on rolls 38, 40 corresponds generally with the spacing between the successive crests on the section of the corrugated strip between spring plate 22 and the rolls 38, 40.

At a location spaced downstream from rolls 38, 40, there is arranged a second pair of rolls 42, 44 which are also spaced vertically apart to engage between the successive upper and lower crests of the corrugated strip in the same manner as the teeth of rolls 38, 40. An additional roll 46 is located downstream in the path of travel of the corrugated strip from rolls 42, 44. Roll 46 is supported above the strip so that the teeth thereof engage between the top crests of the strip advancing on rail 24. Downstream from the roll 46 there is journalled a further toothed roll 48. The roll 48 is formed with a pair of diametrically opposite slots 50 for accommodating a rotary saw blade 52 that is reciprocated vertically intermittently by a cylinder 54 or other suitable means.

Rolls 38, 40 will hereinafter be referred to as "feed rolls" and rolls 42, 44, 46 will be referred to hereinafter as a"unpacking rolls". Feed rolls 38, 40 are keyed or otherwise fixed to rotate with shafts 54, 56. Unpacking rolls 42, 46 are supported to rotate on shafts 58, 62, respectively. Unpacking roll 44 is keyed to shaft 60 and roll 48 is keyed to rotate with shaft 64. Shafts 58, 60 for rolls 42, 44 are mounted on the frame of the machine and driven. The shafts of rolls 38, 40 are mounted on the frame in a similar manner. The manner of driving the rolls is shown in the aforementioned U.S. Pat. No. 4,507,948 which is incorporated herein by reference. The lower rolls 40, 44 are driven at the same speed as the upper rolls 38, 42 by meshing gears on shafts 54, 56 and 58, 60. Shafts 54, 56, 58, 60, 62, 64 are all rotated at the same speed. The drive arrangement for these shafts include one or more sprockets at the rear ends of shafts 54, 58, 62, 64. All of such sprockets have the same diameter and the same number of teeth. Shafts 54 and 64 are provided with a single sprocket while shafts 58 and 62 are provided with two sprockets. The successive sprockets are connected by separate drive chains (not illustrated) and one of the drive chains is driven by a main drive sprocket which imparts the same intermittent rotary motion to all of the sprockets and each of the toothed rolls 38, 40, 42, 44, 46, 48.

To facilitate the explanation of the operation of the above-described arrangement, let us assume that spring plate 22 is adjusted to compress the corrugated strip lengthwise so that in the section thereof between plate 22 and feed rolls 38, 40 the spacing of the crests 36 is such that there are sixteen convolutions per inch of strip. Let us further assume that in the finished strip, it is desired to have nine convolutions per inch. It is, therefore, apparent that the strip must be stretched to an extend that each finished cut-to-length strip section contains nine uniformly spaced crests per inch. In the present arrangement this is readily accomplished by reason of the particular manner in which rolls 42, 46 are adjustably mounted on their respective shafts.

When operation of the apparatus is initiated, the leading end of the corrugated strip is directed between the rotating feed rolls 38, 40 and to a position directly adjacent the unpacking rolls 42, 44. Roll 38 is rotated slightly in a counter-clockwise direction as shown in FIG. 7 to engage the crests 26 at the leading end of the strip between the teeth on rolls 42, 44. It will be appreciated that, when roll 42 is rotated, roll 44 will be likewise rotated. The spacing between shafts 54 and 58 in a direction lengthwise of the strip being a known dimension, it then becomes a relatively simple matter to rotate roll 42 in a further counter-clockwise direction so as to stretch the section the strip between rolls 38 and 42 to an extent such that the number of crests between rolls 38, 42 correspond to a desired number of crests per unit length. For example, if shafts 54, and 58 are spaced six inches apart and it is desired to increase the spacing of the crests in the section of the strip between these two rolls from sixteen per inch to twelve per inch, then roll 42 is rotated to an extent such that the section of the corrugated strip between rolls 38 and 42 contains seventy-two crests.

After roll 42 is adjusted as described above, the motor which drives the apparatus is jogged to advance the corrugated strip lengthwise to a position wherein the leading end is located directly adjacent the teeth of roll 46. Roll 46 is then adjusted in the same manner as previously described with respect to roll 42 so as to stretch the section of the corrugated strip between rolls 42 and 46 to an extent so that it contains nine crests per linear inch. Since the material from which the corrugated strip is formed has substantially no spring-back, when the apparatus is thereafter operated on a continuous basis the crest spacing on the section of the strip between rolls 38 and 42 will remain at twelve per linear inch and the crest spacing on the section of the strip between rolls 46 and 48 will remain at substantially nine per linear inch. It then becomes a simple matter then to operate rolls 42, 46, 48 intermittently and reciprocate saw 52 so that the finished corrugated strip is cut into successive sections of desired length. It will be appreciated, however, that in the event the metal from which the corrugated strip is formed has a slight spring-back characteristic, then roll 46 can be adjusted to produce say ten crests per inch, rather than nine.

After the supply of ribbon stock from a coil is exhausted, it becomes necessary to stop the machine, remove the spool of exhausted coil, replace it with a fresh coil and restart the machine. Thus, as explained previously, it becomes necessary to again stretch the leading end of the coil between rolls 38 and 42 and between rolls 42 and 46. To the extent thus far described, the apparatus is substantially shown and described in U.S. Pat. No. 4,507,948, which is incorporated herein by reference.

Figure 2:
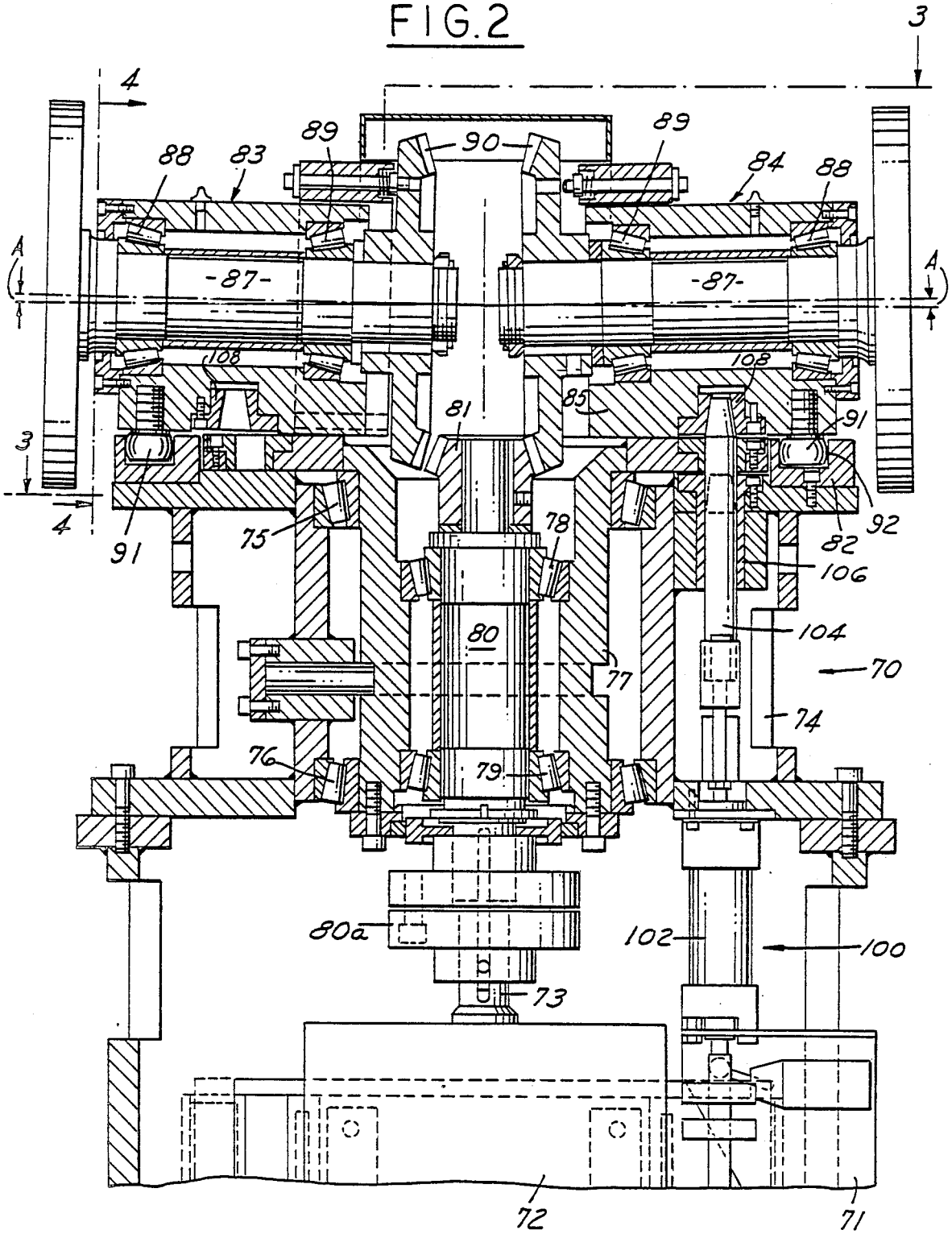
FIG. 2 is a fragmentary sectional view on an enlarged scale taken along the line 2—2 in FIG. 1.
Figure 3:
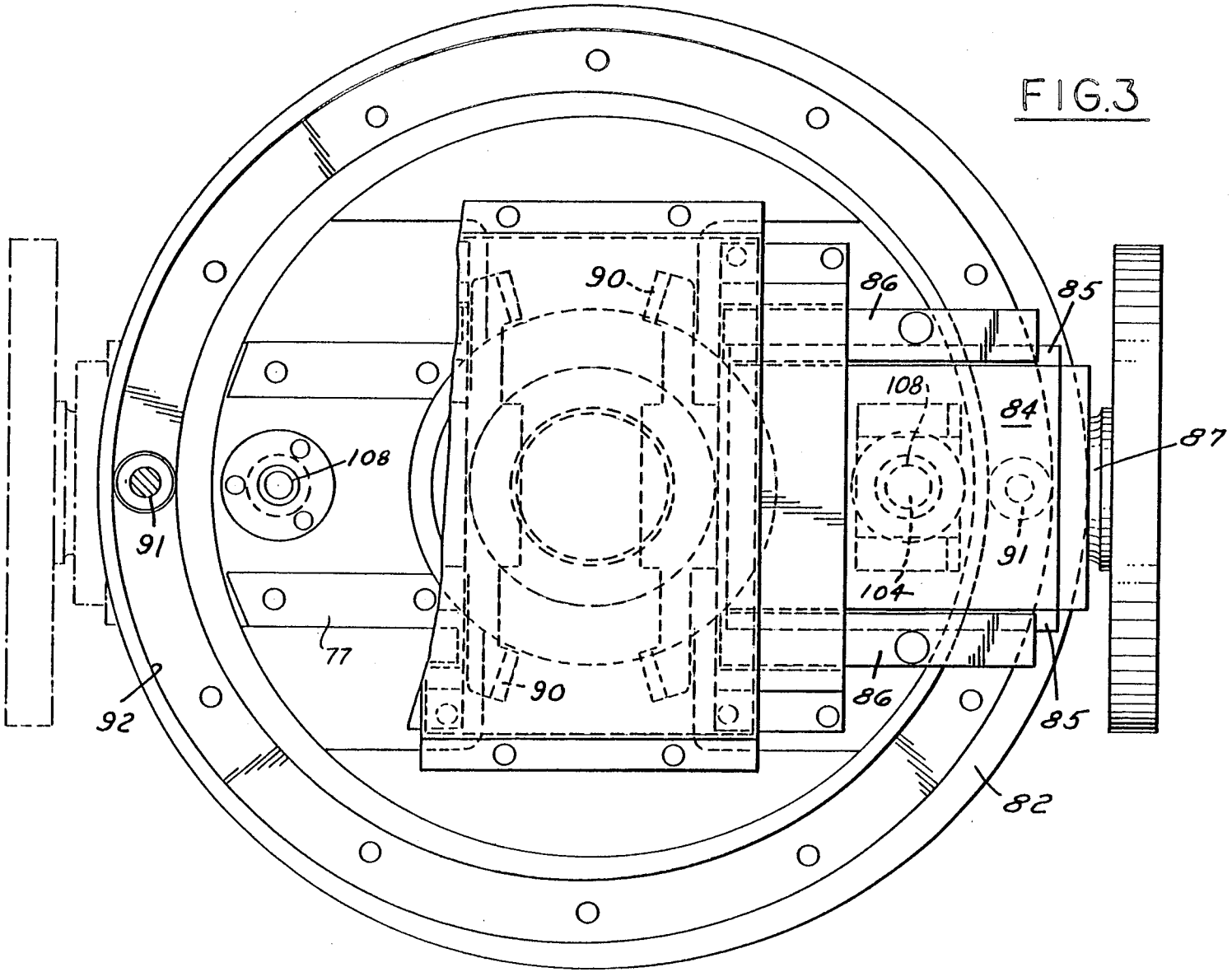
FIG. 3 is a fragmentary sectional view on an enlarged scale taken along the line 3—3 in FIG. 2.
Figure 4:
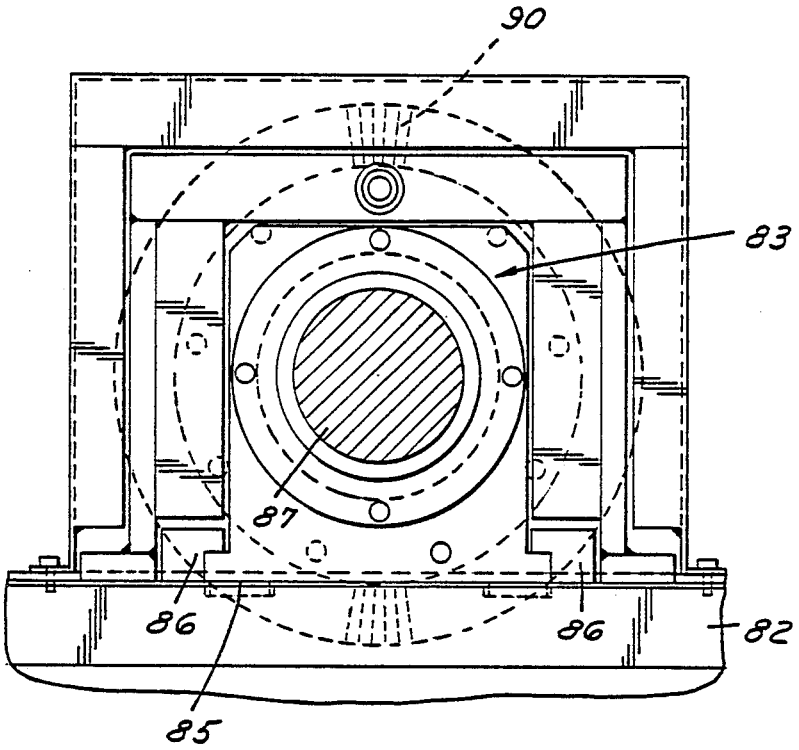
FIG. 4 is a fragmentary sectional view taken along the line 4—4 in FIG. 2.

In accordance with the invention, a novel uncoiler stand 70 is provided. Referring to FIGS. 1–5, the uncoiler stand 70 comprises a base 71 in which a motor 72 is mounted with its output shaft 73 extending vertically. A roller bearing support 74 is mounted on base 71 and supports a first set of roller bearings 75, 76. Bearing 75, 76 carry a second rotatable table or support 77. A second set of roller bearings 78, 79 are carried by support and rotatably support a connecting shaft 80. Shaft 80 is driven by motor shaft 73 through a coupler **80*a* (FIG. 2). A bevel gear 81 is fixed on the upper end of the shaft 80. In this manner the motor 72 can continuously rotate the bevel gear 81, with the shaft 80 which defines the axis of rotation being supported by frame 71, supports 74, 77 and bearings 75, 76, 78, 79**.

A plate 82 is mounted on the upper end of support 74. A diametrically opposed pair of coil supports 83, 84 each include a slide base 85 carried for motion radially of the shaft axis by opposed tracks 86 on rotatable support 77. Each slide base 85 has a spindle 87 rotatably carried by bearings 88, 89. A bevel gear 90 is carried by each spindle 87 for meshing engagement with gear 81. The axis of the spindle 87 is preferably inclined at a slight angle A in order to insure proper engagement with the bevel gear 81. Each slide base 85 has a cam follower roller 91 depending therefrom and engaged with an eccentric annular track 92 in plate 82. Thus, coil supports 83, 84 move radially with respect to the axis of shaft 80 into and out of engagement with gear 81 as support 77 is rotated. The gear 81 and gears 90 thus form interengaging means between the coil supports and the motor drive. In the drawings, support 84 is engaged with gear 81.

A lock 100 is carried by support 74 and comprises a fluid cylinder 102 coupled to a pin 104 carried by a sleeve bearing 106 for sliding motion parallel to the axis of shaft 80. Pin 104 has a tapered head which engages a seat 108 in base 85. Thus, with pin 104 in the retracted position shown in dashed lines in FIG. 2, support 74 may be rotated about the axis of shaft 80. However, when pin 104 is in the position shown in solid lines, such rotation is prevented.

Figure 5:
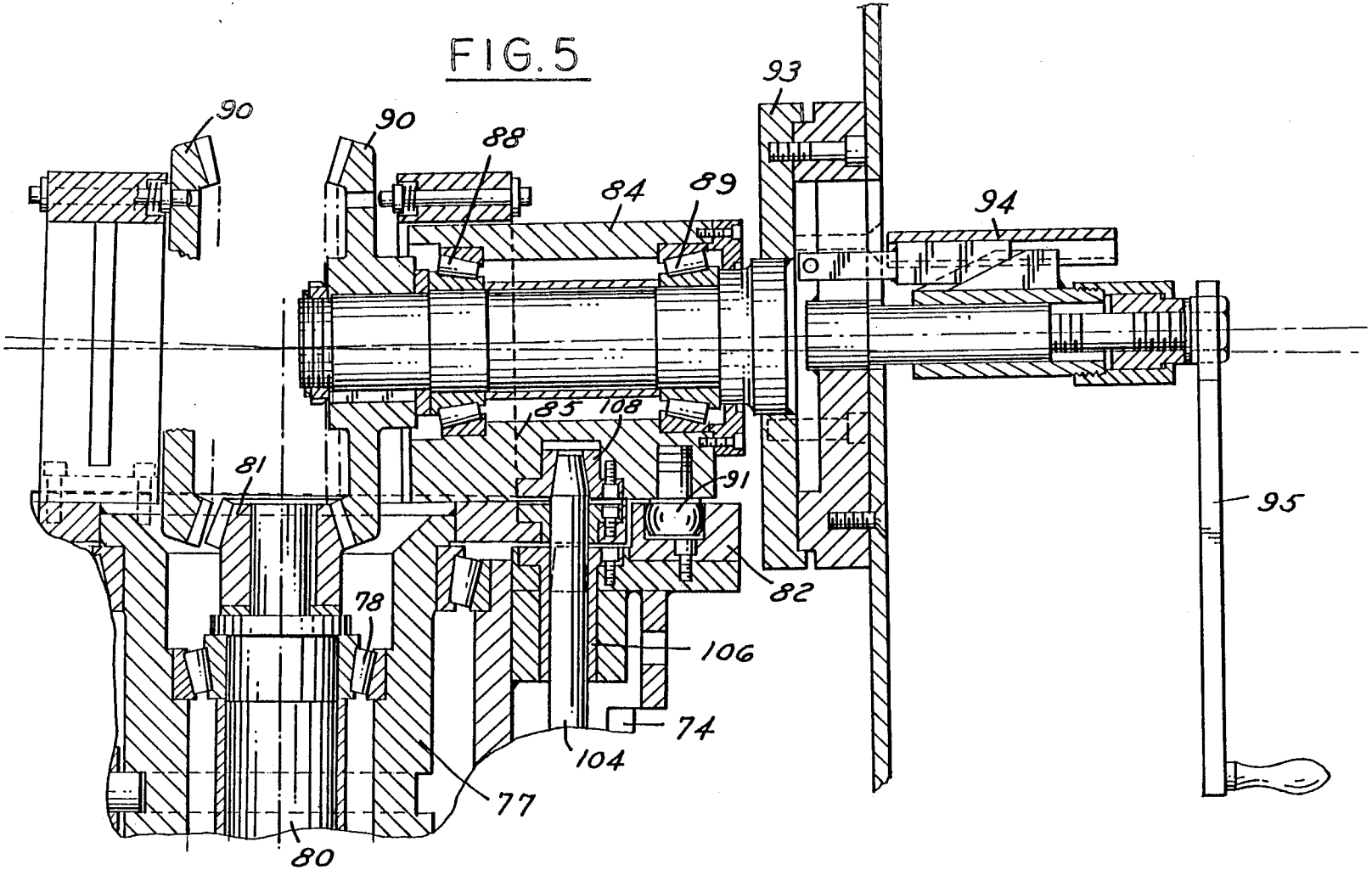
FIG. 5 is a fragmentary sectional view similar to FIG. 2 showing the manner in which a change of coils is provided.

Each spindle 87 is adapted to support a coil of ribbon stock for rotation about a horizontal axis. Referring to FIG. 5, each spindle 87 includes an end plate 93 that supports an expandable arbor 94 which is movable by a removable crank 95 to expand or retract the arbor into frictional engagement with a core of the ribbon coil stock. Thus, an apparatus is provided wherein a coil is in position for uncoiling and another coil can be placed in position for immediate use after the ribbon stock in the first mentioned coil is exhausted. In order to achieve this, the shot pin 104 is retracted, the support 77 is manually rotated and, during such rotation, the cam followers rollers 91 cause the respective coil supports from which the ribbon stock is exhausted to move out of engagement with the bevel gear 81 and to cause the coil support with the full supply of ribbon stock to move into engagement with the bevel gear 81.

Figure 6:
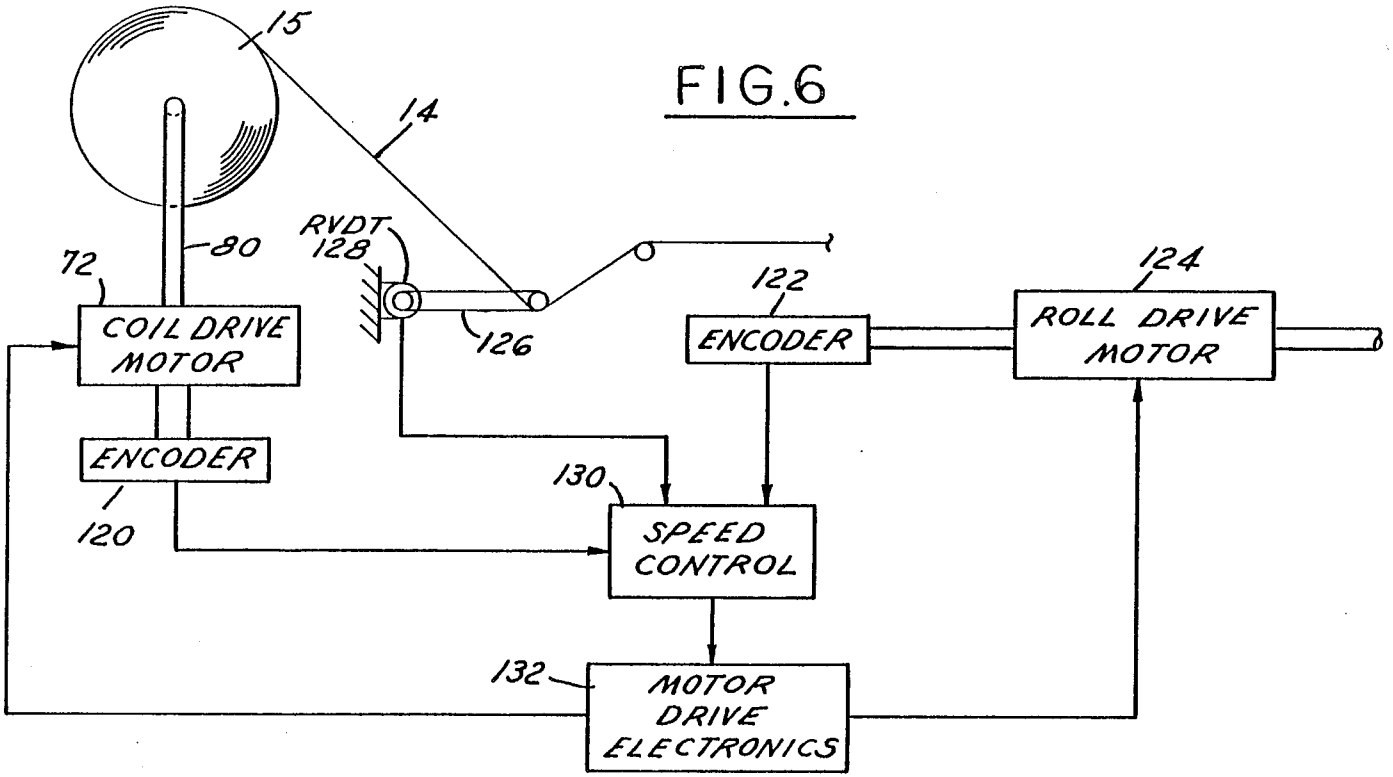
FIG. 6 is a functional block diagram of a system for controlling speed of the coil drive motor.

FIG. 6 is a functional block diagram of motor drive electronics in accordance with the invention for driving coil unwind motor 72. An encoder 120, such as a tachometer, position encoder, a resolver or the like, is coupled to shaft 80 and provides a signal indicative of motor output velocity. A similar encoder 122 is coupled to the motor 124 which drives the apparatus with rollers (FIG. 1). Web 14 is trained from roll 15 around a dancer arm 126 (FIGS. 1 and 6). Arm 126 is pivotally coupled to a fixed support by RVDT 128, which thus provides an output indicative of arm position. Encoders 120, 122 and RVDT 128 are connected to speed control electronics 130, which provides output to motor drive electronics 132 for driving motors 72, 124.

In general, speed of rotation of motor 124 is determined by desired output velocity and pitch of corrugated material. Speed of motor 72 is controlled accordingly. Initially, motors 72, 124 are operated at the same speed. Depending upon diameter of coil 15, dancer arm 126 may fall, indicating that motor 72 is too fast, or may rise, indicating that motor 72 is too slow. Thereafter, as web 14 is unwound from coil 15 and the effective radius thereof decreases, speed of rotation motor 72 is progressively increased as a function of output of RVDT 128 to provide constant lineral web volocity.

The invention claimed is:

1. For use in an apparatus for rolling metal ribbon stock into convoluted pin strip for use in heat exchangers, an uncoiler apparatus comprising:

a base, a pair of coil supports for supporting a pair of coils of sheet metal ribbon stock, a rotatable support on which said coil supports are mounted, said rotatable support being rotatable about a vertical axis, a motor drive, means on said rotatable support for guiding said supports for radial movement into and out of engagement with said motor drive, interengaging means between the coil supports and the base such that when the rotatable support is rotated, one coil support is moved radially into driving engagement with the motor drive and the other coil support is moved radially out of driving engagement with the motor drive.

2. The uncoiler apparatus set forth in claim 1 wherein said interengaging means comprises a stationary eccentric annular cam on said base, and a cam follower on each said coil support engaging said cam.

3. The apparatus set forth in claim 1 wherein said motor drive has an output gear, each said coil support having a complementary gear selectively moved radially into and out of engagement with the output gear of the motor drive.

4. The uncoiler apparatus set forth in claim 1 wherein each said coil support is movable at a slight angle radially inwardly and downwardly toward the output gear of the motor drive and at a slight angle radially outwardly and upwardly away from the output gear of the motor drive.

* * * * *